US005291861A

United States Patent [19]

Bartlett

[11] Patent Number: 5,291,861

[45] **Date of Patent: * Mar. 8, 1994**

[54] MOVING STARTER SYSTEM

[75] Inventor: Gregory A. Bartlett, Chemung, N.Y.

[73] Assignee: Ingersoll-Rand Company, Woodcliff Lake, N.J.

[ * ] Notice: The portion of the term of this patent subsequent to Oct. 26, 2010 has been disclaimed.

[21] Appl. No.: 892,832

[22] Filed: Jun. 2, 1992

[51] Int. Cl.[5] ..... F02N 7/08

[52] U.S. Cl. ..... 123/179.31; 74/7 E

[58] Field of Search ..... 123/179.31, 179.25; 60/625, 626, 627; 74/7 E; 290/48

[56] References Cited

U.S. PATENT DOCUMENTS

| | | | |
|---|---|---|---|
| 1,337,973 | 4/1920 | Bijur | 290/48 |
| 1,951,031 | 3/1934 | Nardone | 123/179.31 |
| 1,951,032 | 3/1934 | Nardone | 123/179.31 |
| 2,295,288 | 9/1942 | Nardone | 123/179.31 |

*Primary Examiner*—Andrew M. Dolinar
*Attorney, Agent, or Firm*—Walter C. Vliet

[57] ABSTRACT

An engine starter having an internal liner which carries forward the motor and gear reducing assembly in unison to engage the engine simultaneously providing power to the engine starter. Movement of the liner performs the valving or switching function to permit starter function.

7 Claims, 1 Drawing Sheet

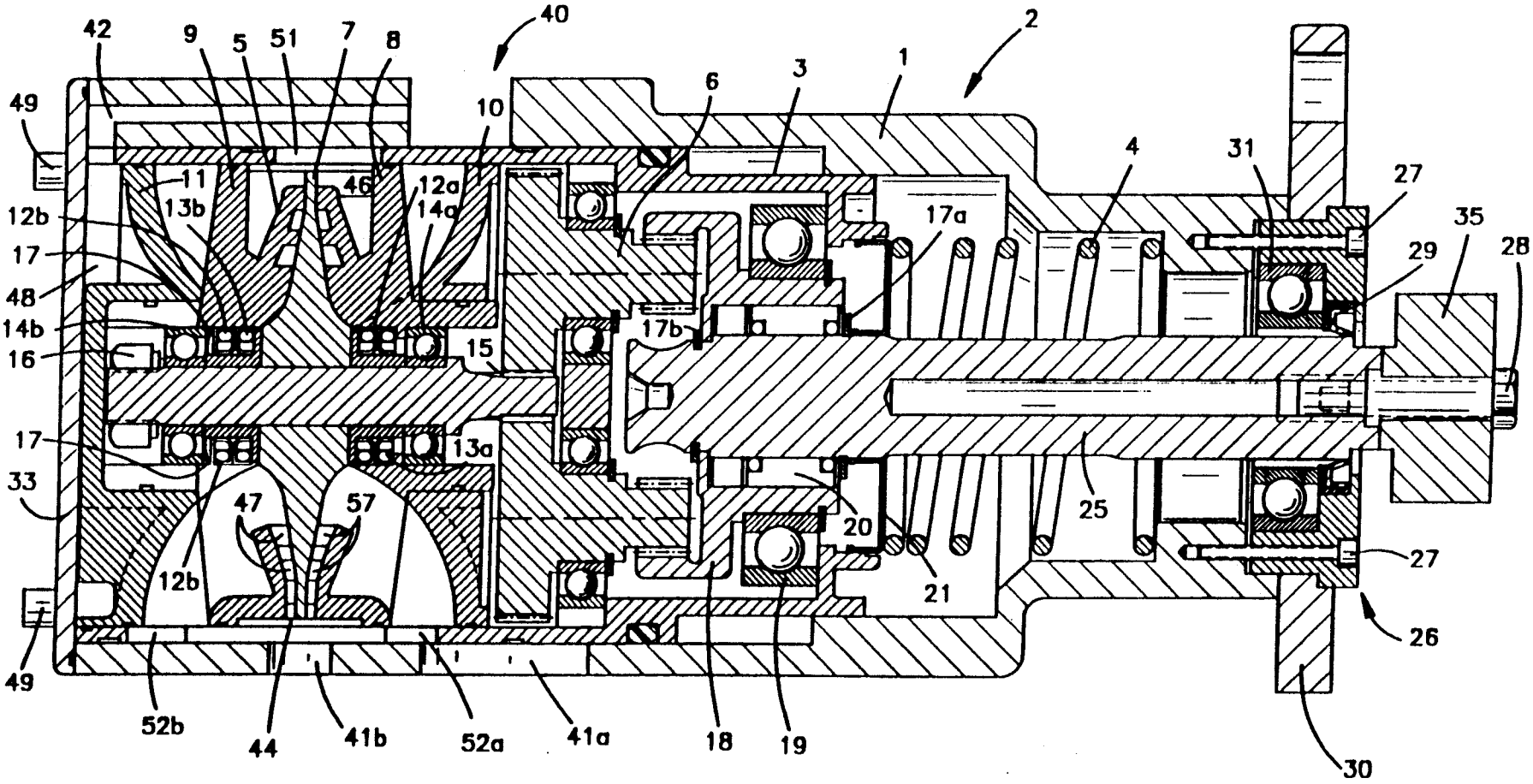
28
35
29
27
27
26
30
31
4
25
2
1
17a
21
20
3
19
6
18
17b
40
41a
10
15
13a
52a
12a
14a
8
46
57
41b
7
51
44
5
47
9
11
13b
12b
52b
42
49
12b
17
48
14b
16
17
33
49

MOVING STARTER SYSTEM

BACKGROUND OF THE INVENTION

This invention relates generally to starters for engines and the like and more particularly to pneumatically driven starters having an output on a pinion gear which engages an engine flywheel or the like. The invention further relates to starters which provide full engagement of the starter pinion with an engine flywheel prior to application of starting power.

In a number of prior art starters the pinion shaft carrying the pinion was extended by several means. Three of these include pneumatically pre-engaged, inertia driven, and electrically pre-engaged. A pneumatically pre-engaged pinion requires extra hoses to shuttle air to a piston. An inertia driven system requires elaborate helical splines. An electric starting system requires a solenoid for engagement, which may be bulky in size, and costly.

The foregoing illustrates limitations known to exist in present pneumatic and electric starters. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a moving starter system comprising an elongate casing, an elongate liner mounted for reciprocation within the casing from a first non-operating position to a second operating position, a motor mounted within the liner having its rotary output transmitted to a pinion for selective engagement with a gear means for rotating the engine, and means for supplying motive media to the motor and for transporting the liner to said second operating position wherein the pinion engages the gear and the motor receives motive media.

The foregoing and other aspects will become apparent from the following detailed description of the invention when considered in conjunction with the accompanying drawing FIGURE.

BRIEF DESCRIPTION OF THE DRAWING FIGURE

FIG. 1 is a sectional view of the generally cylindrical form starter according to the present invention.

DETAILED DESCRIPTION

Referring to FIG. 1, a moving starter system 1 according to the present invention is generally cylindrical in form having a hollow cylindrical outer housing 2. An inner housing or liner 3 is disposed within the outer housing 2 for longitudinal reciprocation therein. The inner housing or liner 3 has contained within its hollow center a motor 5 and a transmission 6 which in turn drives a drive pinion shaft 25 which extends from the liner 3 through a housing cover 26 which closes one end of the housing 2. The shaft 25 has mounted on its exposed outside end a drive pinion 35 which is retained on the drive shaft 25 by means of a drive pinion screw 28.

By way of further explanation in the form of a preferred embodiment, a pneumatically operated engine starting motor of the radial inward flow type is utilized to power the starter. The air turbine motor 5 is comprised of a front deflector 10 and a rear deflector 11 generally forming the ends of a housing which along with the liner 3 contain the front stator 8 and the rear stator 9.

A rotor 7 is mounted for rotation in front and rear shaft bearings 14*a* and 14*b*, respectively. The bearings are positioned in the front stator 9 and rear stator 8. Suitable rotor shaft seals 12*a* and 12*b* are provided to prevent loss of pressure fluid between the rotor bearing spacers 13*a* and 13*b* and the stators 8 and 9. The rotor 7, bearing spacers 13*a* and 13*b*, rotor shaft seals 12*a* and 12*b*, and shaft bearings 14*a* and 14*b* are assembled on the rotor shaft 15 and maintained thereon by means of a rotor lock nut 16. Proper compression between the seal components is maintained by a wavy washer 17 interspaced between the rear shaft bearing 14*b* and the rear rotor bearing spacer 13*b*.

It should be appreciated by one skilled in the art that air entering the motor through nozzle ring 44 is expanded through the stator blades 47 against the rotor blades 57 to impart rotation to the rotor and power to drive the starter.

The gear reducer shown is of the conventional idler gear form having its output on a ring gear 18 which is mounted for rotation within the liner 3 by means of a bearing 19. The rotary output of the ring gear is imparted to the shaft 25 through a one way clutch 20 which permits drive in the starting rotation direction only and permits overrun of the drive shaft 25 once the engine has started without overspeed of the remainder of the starter components.

The shaft 25 is retained in the one way clutch 20 and ring gear 18 by means of retainers 17*a* and 17*b*. A shaft seal 21 prevents foreign matter from entering the gear reducing cavity and retains lubricant therein. A return spring 4 is provided to translate the liner 3 and its contained components to the rear of the starter housing 2.

The drive shaft 25 is positioned within the housing cover 26 by means of a drive shaft bearing 31. The housing cover 26 is secured to the housing 2 by means of cap screws 27. A drive housing seal 29 is provided to prevent foreign matter from entering the starter cavity.

The starter is further mounted to an engine to be started by means of a flange 30 which positions the starter to engage the drive pinion gear with a mating gear on the engine when the pinion shaft 25 is extended from the housing.

The housing 2 is provided with a pneumatic fluid or air inlet 40. A passageway 42 transmits the pressure fluid to a chamber 43 formed at the rear end of the starter between the rear deflector 11 and back plate 33. Back plate 33 is secured to the housing 2 by means of cap screws 49.

It may now be appreciated by one skilled in the art that once pressure fluid is applied to the starter the chamber 43 will become pressurized and will translate the liner 3 towards the front end of the starter against the force of return spring 4 carrying with it the motor 5, gear reducer 6, and shaft 25.

Once the liner 3 is translated to the engaged position, pressure fluid is permitted to enter liner inlet port 51 and circumferential distribution passage 46 which communicates with the nozzles 44. Air passing through the nozzles 44 is expanded through the stator blades 47 and the rotor blades 57 to impart rotation to the rotor 7 as previously described.

Expanded pressure fluid exits the motor by means of exhaust port 52*a* and 52*b* in the liner 3 and corresponding exhaust holes 41*a* and 41*b*.

Once the engine has started the pressure fluid is removed from inlet 40. Chamber 43 is exhausted rearward through passage 42 and through the motor 5 thereby reducing the pressure in chamber 43 and permitting the return spring 4 to translate the liner to the rear position wherein the cycle is completed.

It should further be appreciated that once the engine has started the one way clutch 20 permits overrunning of the drive pinion without damage until such time as the return spring withdraws the drive pinion 35 from engagement with the engine.

Having described the invention, what is claimed is:

1. A starting system for an engine comprising:

an elongate casing;

an elongate liner mounted for reciprocation within said casing from a first non-operating position to a second operating position;

a motor mounted within said liner having its rotary output transmitted to a pinion for selective engagement with a gear means for rotating said engine; and means for supplying motive media to said motor and for transporting said liner to a second operating position wherein said pinion engages said gear and said motor receives motive media.

2. A starting system for an engine according to claim 1, wherein said means for supplying motive media to said motor further comprises a non-aligned port in said liner in said first non-operating position, said receiving port becoming aligned with a motive media supply port in said casing in said second operating position.

3. A starting system for an engine according to claim 1, wherein said motor comprises an air turbine motor.

4. A starting system for an engine according to claim 1, wherein said motor includes a gear reducing means.

5. A starting system for an engine according to claim 1, wherein the connection between said motor and said pinion includes a one way clutch means for preventing overrun of said motor once the engine has started.

6. A starting system for an engine comprising:

an elongate casing forming a cylinder;

an elongate liner containing a motor and a gear reducer entirely supported within said liner;

said liner motor and gear reducer forming an integral piston combination within said elongate casing;

means for reciprocating said piston to selectively engage an engine to be started; and means for connecting said motor to a power source during said selective engagement.

7. A starting system for an engine according to claim 6, wherein said piston means is translated by motive pressure fluid to engagement and returns when motive fluid is removed by spring means.

* * * * *